United States Patent [19]

Vanhelle

[11] 4,033,102

[45] July 5, 1977

[54] METHOD AND APPARATUS FOR TWISTING CORE STRANDS

[75] Inventor: Michel E. Vanhelle, Wattrelos, France

[73] Assignees: Centre Technique Industriel dit: Institut Textile de France, Boulogne-sur-Seine; Etablissement Public dit: Agence Nationale de Valorisation, Neuilly-sur-Seine, both of France

[22] Filed: Mar. 22, 1976

[21] Appl. No.: 668,987

[30] Foreign Application Priority Data

Mar. 21, 1975 France ..... 75.08951

[52] U.S. Cl. ..... 57/12; 57/34 R; 57/160

[51] Int. Cl.[2] ..... D02G 3/36

[58] Field of Search ..... 57/3, 6, 12, 14, 36, 57/51, 51.5, 51.6, 156, 160, 34 R, 34 AT

[56] References Cited

UNITED STATES PATENTS

| | | | |
|---|---|---|---|
| 3,255,579 | 6/1966 | Price | 57/12 |
| 3,286,449 | 11/1966 | Carroll | 57/36 X |
| 3,377,792 | 4/1968 | Walls et al. | 57/34 AT |
| 3,389,545 | 6/1968 | Grunder et al. | 57/36 X |
| 3,443,370 | 5/1969 | Walls | 57/34 AT |
| 3,444,677 | 5/1969 | Henry | 57/12 |
| 3,448,571 | 6/1969 | Tsuzuki | 57/106 X |
| 3,460,338 | 8/1969 | Morrison | 57/12 X |
| 3,738,093 | 6/1973 | Ingham | 57/36 |

*Primary Examiner*—Donald Watkins
*Attorney, Agent, or Firm*—Dennison, Dennison, Meserole & Pollack

[57] ABSTRACT

The invention comprehends a method of twisting core strands, of the type comprising a sheath of fibres surrounding a central strand, a method in accordance with which a sliver of fibres is drawn between a point of entry of the said sliver and a pair of downstream drawing cylinders, a central strand is drawn under constant tension and is introduced without drawing into the sliver upstream of the said drawing cylinders, characterized in that a torsion in one sense and the other is conferred successively on the assembly constituted by the sliver of fibres and the central strand downstream of the said drawing cylinders.

The invention further comprehends apparatus for twisting a core strand of the type comprising a sheath of fibres surrounding a central strand, the said apparatus comprising a double sleeve drawing assembly comprising drawing cylinders for the drawing of at least one sliver of fibres and a device feeding under constant tension at least one central strand for introducing the said central strand into a sliver of fibres upstream of the drawing cylinders downstream of the drawing assembly, characterized in that, it comprises an auto-twisting assembly disposed downstream of the drawing assembly and comprising auto-twist cylinders for conferring a torsion successively in one sense and the other on the assembly constituted by the sliver of fibres and the central strand.

9 Claims, 3 Drawing Figures

Figures 1, 3:
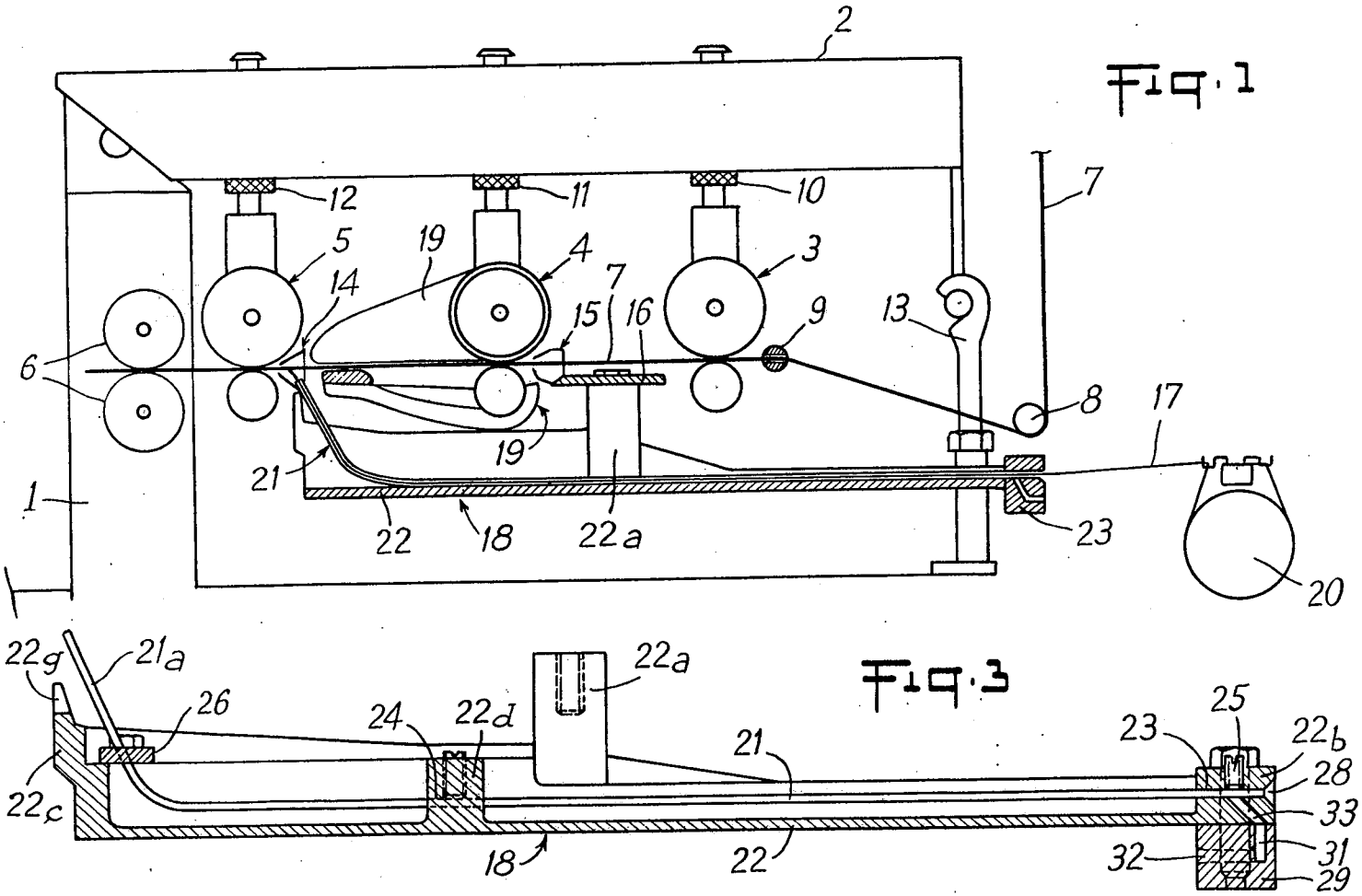

1
2
3
4
5
6
7
8
9
10
11
12
13
14
15
16
17
18
19
20
21
22
22a
23
21a
22b
22c
22d
22g
24
25
26
28
29
31
32
33

METHOD AND APPARATUS FOR TWISTING CORE STRANDS

The subject matter of the present invention is a method and an apparatus for twisting core strands and more particularly for obtaining auto-twisted core strands.

Core strands in which a central strand is enveloped in a sheath of discontinuous fibres are known. The central strand may be a strand of continuous filaments or a strand of previously spun discontinuous fibres. This central strand may be a non-elastic strand or a drawn strand, that is to say, in the latter case, either a really elastic strand or a strand of continuous non-elastic texturised filaments. Methods of obtaining core threads are described particularly in U.S. Pat. Nos. 1,373,880, 2,024,156, 2,210,884, 2,313,058, 2,504,523, 2,526,523, 3,017,740 and 3,038,295. The production of core threads may be effected by numerous spinning systems commonly used for the production of yarns from short or discontinuous fibres. However, and in particular with the system for wool, spun core strands generally have the disadvantage of a bad covering of the central strand by the sheath of discontinuous fibres and the central strand appears through the sheath. This disadvantage involves a particularly undesirable effect if a noticeable difference in colour exists between the constituents of the central strand and the sheath of fibres, as is often the case for example, when the fibres of the sheath are tinted in bulk before the spinning of the core strand. Another disadvantage in spinning core strands by the known systems, resides in the limitation in the speed of production to that of the machines utilized and thus to the system of spinning utilized.

Auto-twisted strands obtained by the natural untwisting in one sense and the other of two plies having previously received a periodic torsion, are also known. A method for the manufacture of auto-twisted strands on an auto-torsion loom and various applications are described, for example, in British Pat. Nos. 1,015,291, 1,121,942 and 1,084,371. However, with the present machines, this method of obtaining auto-twisted strands has the disadvantage of requiring a length of fibres sufficient to obtain a good resistance of the auto-twisted strand, whilst retaining a torsion which is not too great having regard to the existence of zones of zero torsion in each of the two plies.

The object of the present invention is to permit on the one hand the obtaining of core strands having a covering of a central strand clearly improved with respect to that of the known core strands and on the other hand, the obtaining of auto-twisted strands capable of being produced from fibres of whatever length they may be whilst maintaining a high resistance.

This object is achieved by a method for twisting core strands, a method according to which a sliver of fibres is drawn between a point of introduction of the said sliver and a pair of drawing cylinders, the continuous non-drawn central strand is fed under constant tension, it is introduced into the said sliver upstream of the drawing cylinders and in accordance with the invention, a torsion in one sense and in the other sense is conferred successively on the assembly formed by the sliver and the central strand between the drawing cylinders and a point of formation of the core strands.

This object is also achieved by an apparatus for the twisting of core strands comprising a central strand, particularly in the form of a continuous filament, and a sheath of fibres surrounding the central strand, the said apparatus comprising: a double sleeve drawing assembly comprising drawing cylinders for the drawing of at least one sliver of fibres, a device for the introduction under constant tension of at least one continuous filament for introducing the said filament upstream of the drawing cylinders and in accordance with the invention, an auto-twisted assembly comprising auto-twist cylinders disposed downstream of the drawing cylinders.

By conferring a successive torsion in one sense and the other on the assembly formed by the sliver of fibres and the central strand, the central strand is permitted to centre itself automatically in the sliver of fibres and thus to be perfectly covered by the latter. This is due to the fact that on both sides of the auto-twist cylinders the assembly sliver of fibres-central strand is twisted in opposite senses. Thus, there exists a zero portion point within the zone from which the central strand is automatically centred within the sliver the fibres of which are then parallel if the tensions exerted are sufficiently great. Thus, the strand itself penetrates the centre of the sliver before the assembly receives its final torsion. For this reason, a capacity for the sliver of fibres to satisfactorily cover the central strand is obtained.

At a formation point situated downstream of the auto-twist cylinders, the auto-twisted core strand is formed by the natural untwisting, in one sense and the other, of two slivers of fibres after they have been subjected to a torsion in each sense, at least one of the two slivers being provided with a central strand.

Figure 2:
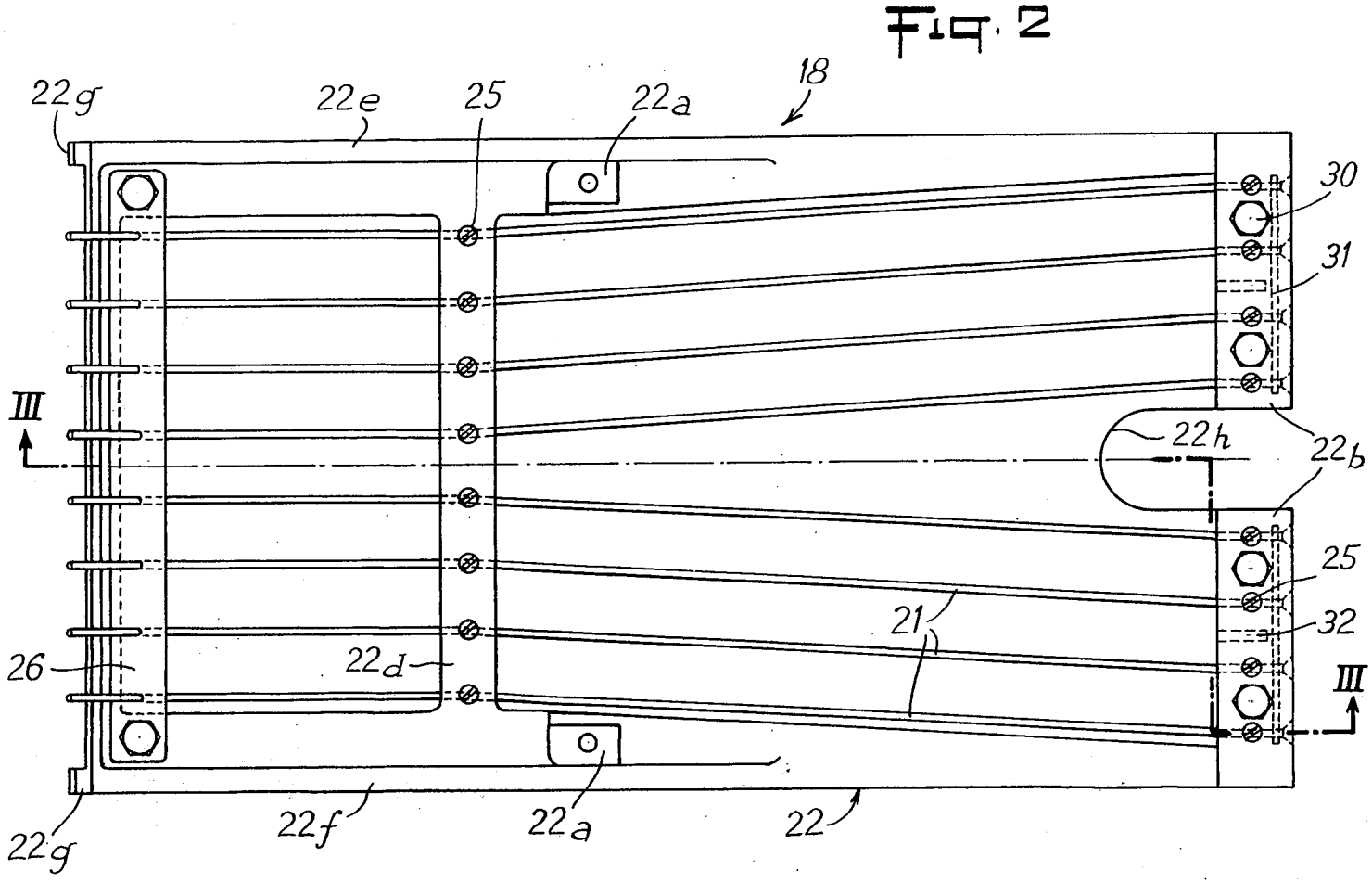

Other advantages and characteristics of the invention will be come apparent from the description of a particular embodiment given below, by way of example but not limiting, with reference to the figures of the accompanying drawings which illustrate diagrammatically:

FIG. 1: a view in elevation of an apparatus in accordance with the invention;

FIG. 2: a plan view of the device for introducing the central strand into the apparatus illustrated in FIG. 1;

FIG. 3: a view in section on the line III—III in FIG. 2.

The apparatus illustrated very diagrammatically in FIG. 1, comprises, mounted on a frame 1, a double sleeve drawing assembly comprising a swinging arm 2 articulated to the frame 1, feed cylinders 3, a system 4 with a double sleeve 19 and drawing cylinders 5 and an auto-twisting assembly comprising auto-twist cylinders 6 disposed downstream of the drawing cylinders 5, in a manner similar to a known auto-torsion loom.

A sliver of fibres 7 is introduced between the feed cylinders with the aid of a guide bar 8 and of a guide 9. Over its path between the feed cylinders 3 and drawing cylinders 5, the sliver of fibres 7 is drawn whilst being controlled by the double sleeve system. The pressure on the feed cylinders 3 from the double sleeve system 4 and the drawing cylinders 5 is exerted by means of the swinging arm 2 in the horizontal position with the aid of springs, the said pressure being adjustable by means of adjusting screws, respectively 10, 11, 12. The swinging arm is maintained in the horizontal position by hooking onto a retaining member 13 integral with frame 1 and adjustable in height.

Immediately upstream of the drawing cylinders 5 the sliver of fibres 7 is guided to a condenser 14 which is integral with a hood (not shown) driven by a to and fro movement so as to distribute the wear on the jacket of the pressure drawing cylinder. A second condenser 15 is situated in the path of the sliver of fibres 7 immediately upstream of the double sleeve system 4, this second condenser being mounted on a small table 16 and driven by a to and fro movement corresponding to that of the condenser 14.

The sliver of fibres 7 is subjected to a first torsion in one sense during its path between the drawing cylinders 5 and auto-twisters 6, these latter being driven by a rotary movement about their axes and an alternating longitudinal translatory movement parallel to their axes. In its path between the auto-twist cylinders 6 and the point of formation of the strand (not shown), the sliver is subjected to a second torsion in the other sense.

A central strand 17, for example a continuous filament, is introduced under constant tension into the sliver of fibres 7 by a introducing device 18 upstream of the drawing cylinders, so as to obtain at the outlet from the apparatus, an auto-twisted core strand. The central strand 17 is unwound from a bobbin (not shown) and brought to the introducing device 18 at a constant tension by means of a positive supply 20. The central strand 17 is introduced into the sliver of fibres 7 at the level of the condenser 14 whilst being conveyed within a tube 21, for example by means of compressed air the stream of which is cut off as soon as the filament 17 has been introduced. The introducing device 18 comprises a support 22 on which is fixed the tube 21 and is driven by a to and fro movement corresponding to that of the condenser 14 whilst being fixed to the small table 16 for example by bolting pillars **22*a* integral with the support 22**.

The feeding device 18 will be described in more detail hereinafter with reference to FIGS. 2 and 3. In practice, a plurality of slivers such as 7 are introduced in parallel into the apparatus described above which comprises a corresponding number of condensers 14 and 15. In the example illustrated, this number is equal to 8, also the introducing device 18 comprises 8 tubes 21 grouped substantially parallel on the support 22. This support has substantially the shape of a rectangular plate provided on its upper surface with three transverse parallel ribs, one rib **22*b* situated along the rear edge, one rib 22*c* situated along the front edge and an intermediate rib 22*d*. At their rear portions, the tubes 21 are housed in bores 23 machined in the rib 22 and passing into bores 24 machined in the intermediate rib 22*d*. Locking screws 25 maintain the tube 21 in position within the bores 23 and 24. The support 22 is housed beneath the feed cylinders 3 and the double sleeve system 4, the tube 21 having an upwardly bent shape at their front portion 21*a* in such a manner that each of them emerges exactly within a condenser 14. The spacing between the tube 21 at their front portions is maintained by means of a plate 26 screwed to the support 22 and having orifices 27 within which pass the end portions 21*a* of the tubes 21**.

Furthermore the support 22 has two longitudinal side ribs **22*e* and 22*f* which are extended towards the front by lugs 22*g* which are housed within the supporting hood for the condensers 14 so as to ensure a perfect synchronism of the to and fro movement of the forward portions 21*a* of the tubes and of the condenser 14. As already referred to, the support 22 is fixed to the small table 16 by means of pillars 22*a* which project vertically from its upper surface on each side of the support. Finally, at its rear portion, the support 22 has a central notch 22*h* providing a passage for the retaining member 13**.

A central strand 17 is brought into a tube 21 by an entry nozzle 28 emerging coaxially within the bore 23. Furthermore, one end of the duct 33 emerges within the said bore, which duct is inclined with respect to the axes of the bore 23 in the sense of displacement of the central strand within the tube and which issues at its other end beneath the support 22. Beneath the rear portion of the support 22, at the level of the rib **22*b*, there are disposed two transverse members 29 one on each side of the notch 22*h*. These transverse members 29 are fixed beneath the support 22 by screws 30 and each has a groove 31 communicating on the one hand with the ducts 33 and on the other hand through conduits 32 with a source of air under pressure (not shown). Thus, a central strand 17 introduced into the nozzle 28 is propelled by a jet of compressed air into the sliver of fibres 7 as far as the drawing cylinders 5**.

The inner diameter of the tube 21 as well as the air pressure necessary for the propulsion of the central strands will be selected as a function of the nature thereof. For example, an inner diameter of the tubes 21 equal to 2 millimeters and an air pressure of 5 $kg/cm^2$ have been adopted for a central strand of 67 deniers, that is to say a diameter of 84 microns.

By means of the method of entry described above, a correct centering of the continuous central strand is produced with respect to the sliver of fibres if the central strand is introduced with sufficient tension. In fact, if it is assumed that the central strand is not correctly centered within the sliver of fibres being subjected to a torsion in one sense at a first point immediately downstream of the auto-twist cylinders 6, the central strand arriving at a second point upstream of the drawing cylinders 5 is twisted in an inverse sense and its torsion between these two points thus passes through zero. For this reason, the fibres of the sliver then being parallel, the continuous central strand, by virtue of the tension to which it is subjected, penetrates the centre of the sliver of fibres before the core strand formed by the sliver of fibres surrounding the central strand receives its final torsion.

The apparatus is supplied with a number of pairs of slivers and produces half the number of auto-twisted strands each obtained at a point of formation of the strand by the natural untwisting in one sense and in the other of two slivers of fibres having been successively twisted in opposite senses between the drawing cylinders and the said point of formation of the strand.

As illustrated in the example, by introducing a central strand into each drawn sliver of fibres, auto-twisted core strands each comprising two central strands are thus finally produced.

By way of a variant, a central strand could be introduced into only one of the two slivers of fibres, the strand being obtained by combination of a simple sliver and of a sliver comprising a central strand and thus becoming an auto-twisted core strand comprising only a single central strand.

Thus, on the one hand, a core strand having a very good capacity for being covered by the sliver of fibres covering the continuous central strand or strands is obtained, and on the other hand an auto-twisted strand the resistance of which is not affected by the length of the fibres in the sliver, due to the presence of the central strand or strands.

Of course, various modifications or additions may be made to the device described above without departing from the scope of the invention.

I claim:

1. A method of producing core strands of the type comprising a sheet of fibers surrounding a central strand, said method comprising drawing at least a first and a second sliver of fibers between respective entry points and a pair of downstream drawing cylinders, feeding at least one undrawn central strand under constant tension, introducing said central strand without drawing into said first drawn sliver upstream of said drawing cylinders, conferring successively a torsion in one sense and in the other on said second sliver of fibers and on the assembly constituted by said first sliver of fibers and said central strand by passing said second sliver and said assembly through a self-twisting unit downstream of said drawing cylinders, and converging said second sliver with said assembly so that a self-twisted core strand is obtained by the natural untwisting in one sense and in the other of said second sliver and assembly.

2. A method of producing core strands of the type comprising a sheet of fibers surrounding a central strand, said method comprising drawing at least a first and a second sliver of fibers between respective entry points and a pair of downstream drawing cylinders, feeding at least a first and a second undrawn central strand under constant tension, introducing each of said central strands without drawing into a respective drawn sliver upstream of said drawing cylinders, conferring successively a torsion in one sense and in the other to the first and the second assembly constituted respectively by said first sliver and central strand and by said second sliver and central strand, by passing said assemblies through a self-twisting unit downstream of said drawing cylinders, and converging said first assembly with said second assembly so that a self-twisted core strand is obtained by the natural untwisting in one sense and in the other of said assemblies.

3. A method according to claim 1 wherein said central strand is propelled by means of air under pressure on its introduction into said first sliver of fibers.

4. A method according to claim 2 wherein each central strand is propelled by means of air under pressure on its introduction into the respective sliver of fibers.

5. Apparatus for producing a core strand of the type comprising a sheath of fibers surrounding a central strand, said apparatus comprising a double sleeve drawing unit having downstream drawing cylinders for the drawing of at least one sliver of fibers; a feeding device having at least one feed tube for feeding under constant tension, at least one central strand through said tube and introducing said central strand into a sliver of fibers upstream of said downstream drawing cylinders; and a self-twisting unit located downstream of said drawing unit and having self-twisting cylinders for conferring a torsion successively in one sense and the other on said slivers of fibers, at least one of them having a central strand inserted therein, whereby a self-twisted core strand is obtained downstream of said self-twisting cylinders by the natural untwisting in one sense and in the other of said slivers of fibers.

6. Apparatus according to claim 5 and further including means for propulsion by air under pressure of the central strand on its introduction through said tube.

7. Apparatus according to claim 5 and further including positive supply means located upstream of said feeding device for supplying said at least one central strand.

8. Apparatus according to claim 5 and further including at least one condenser located immediately upstream of said downstream drawing cylinders, said tube emerging within said condenser.

9. Apparatus according to claim 8 and further including means for imparting synchronous to and fro movements to said tube and said condenser.

* * * * *